US005651743A

United States Patent [19]

Stephan et al.

[11] Patent Number: 5,651,743

[45] Date of Patent: Jul. 29, 1997

[54] BASKETBALL PRACTICE AID

[76] Inventors: Paul B. Stephan, 15222 Warwick Cir., Westminster, Calif. 92683; Joe Edmond Pryor, 560 W. 43rd St., Apt. 3D, New York, N.Y. 10036; Montel Brian Williams, 200 Rector Pl. #44 B, New York, N.Y. 10280

[21] Appl. No.: 355,029

[22] Filed: Dec. 13, 1994

[51] Int. Cl.[6] ..... A63B 69/00

[52] U.S. Cl. ..... 473/450; 273/DIG. 30; 602/16; 602/20; 473/214

[58] Field of Search ..... 273/1.5 R, 1.5 A, 273/189 R, 189 A, 55 R; 602/DIG. 30, 16, 20; 473/212, 214

[56] References Cited

U.S. PATENT DOCUMENTS

| | | | |
|---|---|---|---|
| 532,461 | 1/1895 | Hoppe | 602/16 |
| 1,643,850 | 9/1927 | Jones | 602/16 |
| 3,900,199 | 8/1975 | McGonagle | 273/189 A |
| 3,975,015 | 8/1976 | Owens et al. | 273/189 A X |
| 4,283,685 | 8/1981 | Bishop | 273/1.5 A |
| 4,373,213 | 2/1983 | Erlandson | 273/189 R X |
| 4,493,316 | 1/1985 | Reed et al. | 602/16 |
| 4,579,341 | 4/1986 | Furr | 273/1.5 A |
| 4,691,924 | 9/1987 | Strong | 273/DIG. 30 X |
| 4,884,561 | 12/1989 | Letson, Sr. | 602/16 |
| 4,919,425 | 4/1990 | Wolf | 273/1.5 A |
| 5,042,464 | 8/1991 | Skwor et al. | 602/16 |
| 5,135,217 | 8/1992 | Swain | 273/1.5 A |
| 5,222,733 | 6/1993 | Brunty | 273/55 R |
| 5,228,682 | 7/1993 | Wolf | 273/1.5 A |
| 5,395,117 | 3/1995 | Ogden | 602/20 X |

OTHER PUBLICATIONS

KBA Basketball coaching and Training Aids 1989 School Mail Order Catalog, p. 13, The Shooter Dec. 1988. Picture of "The Shooter."

*Primary Examiner*—Paul E. Shapiro
*Attorney, Agent, or Firm*—Broadbent, Hulse, Pierce & Pate

[57] ABSTRACT

A brace for training basketball players has a base for fitting over an arm of a user. Either the upperarm or forearm of one arm of a user is referred to the "base member," the remaining member being the "moving member," regardless of which member actually moves. A yoke extends away from the base, forming a cradle for receiving the moving member. The yoke restrains the moving member from closing against the base member at less than a certain angle. The yoke also urges the moving member and base member into a predetermined relative rotation with respect to one another. A band attaches the base to the base member. The band may be a flexible, non-extensible strap having fasteners at the ends for opening, closing and adjusting the strap. A hook-and-loop fastener permits adjustment of a single, wide strap along the length of the base. An adjustment member may be provided for adjusting the position of the yoke relative to the base.

34 Claims, 8 Drawing Sheets

BASKETBALL PRACTICE AID

BACKGROUND

1. The Field of the Invention

This invention relates to athletic training equipment and, more particularly, to novel systems and methods for use in basketball shooting practice.

2. The Background Art

Basketball is a common sport among youths and adults alike. Most amateur athletes (basketball players) develop and practice their shooting techniques without a coach. Like sandlot baseball, basketball is often played with a minimum of equipment, no officiating, no coaching and a makeshift court. Basketball is often played on a driveway or in a schoolyard. Basketball may be played as a solo practice event or one-on-one between friends. Informal teams may form if enough players are present. Individuals learn how to shoot a basketball by watching friends. Sometimes, questions or comments may be exchanged. However, knowledge and skill are limited. Information exchanged or techniques observed are often erroneous. Thus, any skills developed in reliance on informal play are questionable. Practice of those skills may simply solidify poor techniques.

Some players have a coach accessible. Basketball teams are typically coached at junior and senior high schools. However even there, a coach cannot average more than a few minutes per day in individual instruction with a player. Moreover, a coach has little opportunity to carefully observe an individual. Seldom will a coach see a player take the same shot numerous times in succession. Individual players also practice alone, but spend little practice time being observed by a coach. College and professional teams alone have coaches who can spend time observing and correcting each player.

Players need knowledge of what to do. They need to know proper techniques. They also need some way to know whether they are executing the techniques properly during practice. Finally, players need a reminder with each shot, until the proper technique, properly executed is a habit.

Practicing to aquire a skill is most effective if a proper technique is properly executed numerous times. Among other things, practice strengthens required or useful muscles. Practice also creates control. However, practicing a wrong technique or executing a technique improperly teaches wrong technique. Bad practice may be worse than no practice. Poor practice limits a player's ability to perform or to improve in any sport or activity.

Practice should employ proper technique for each shot. Proper technique should be the only technique practiced. The proper technique should be executed properly every time. The technique should be repeated numerous times. A youth aspiring to play collegiate or professional basketball should shoot approximately 300 shots per day. Those shots should be done with proper technique, properly executed, until the technique is habit, even reflex. Control is a direct result of this repeated, identical, correct, habitual positioning and movement of body members.

Muscles are also developed with practice. Repetitions or "reps" are part of any strength training. Proper strength comes from repeating a motion against some resistance, such as a weight, or the body's weight. Muscles should be properly "loaded." That, is they should encounter the proper resistance forces. If additional loading is added, it must be carefully directed to develop muscles in proper balance. A proper balance of the strengths of cooperating muscles comes from repeating the motions associated with a desired skill.

A proper range of motion comes from each body member traversing its full path of motion associated with the desired skill. Motions by a body member are more likely to be correctly executed if begun from a proper position. However, young players and untrained participants may fail to practice proper techniques such as positioning and motion, moreover, they are unlikely to know what they are. Therefore, such individuals will lack both the positioning of the arms, hands and shoulder complex. They will lack muscular development required to shoot a basketball forcefully and in a proper direction required to make a goal shot.

"Neuromuscular memory" is an expression used to describe the development of habits and muscles with practice. It is the sum of habitual patterns that become part of any player's technique and conditioning after frequent and numerous repetitions of motions. Thus, neuromuscular memory is a combination of balanced muscular strength, range of motion and muscular control. It is developed by numerous, frequent repetitions of the physical positioning and motion associated with a properly executed technique for an athletic skill.

No reliable method is available without professional coaching to provide the necessary practice of proper techniques. The individual without a coach relies only on happenstance to learn and practice proper techniques.

BRIEF SUMMARY AND OBJECTS OF THE INVENTION

In view of the foregoing, it is a primary object of the present invention to teach a basketball player the proper positions and motions of arms, hands and shoulders when shooting a basketball. Another object is to remind the participants constantly and in a consistent fashion of those necessary positions and motions during recreation, individual practice, team practice and games.

Another object is to urge proper positioning and motion with every shot. One object of the invention is to position the "throwing hand" of a basketball player properly before a shot. Another object is to position the hand, associated forearm, and upperarm in proper relationship to one another for executing a shot properly. Another object is to urge a player to lift the upper arm and extend the forearm away from the upperarm. Another object is to urge the player to rotate the forearm with respect to the upperarm to position the hand and forearm above and forward of the respective shoulder. Another object is to position the arm of a player to control subsequent motion and follow-through.

Another object is to provide a safe, simple method and apparatus useful in all types of basketball practice environments. Another object is to provide an apparatus organic to (completely self contained with) the user. Other related objects are to minimize the complexity of the apparatus, to avoid bulky hardware, and to avoid requiring any fixed exercise stations.

When shooting a basketball, arm and hand positions at the beginning of a shot are critical. Initial positions and the physical limitations of body members effectively direct subsequent motions. Young players often shoot a basketball with two hands, or "throw" it with a motion similar to a "shot put." In a shot put, the hand moves from the shoulder and is extended the length of the arm. The hand and shoulder are together when the upperarm and forearm are hinged closed from the elbow. Usually, as the upperarm and forearm open, the shot is released.

By contrast, in basketball, the "throwing hand" should be positioned directly above the shoulder and higher than the head. The upperarm and forearm should not be closed together. Neither the upperarm nor the forearm should cross in front of the face of a shooting player. The hand should swing in a long arc on the forearm, the forearm pivoting about the elbow. Before a shot, the elbow should be displaced and moved forward of the head. That is, the elbow should be positioned above and in front of the shoulder. The upperarm is elevated during most of the motion of the forearm. Unfortunately, many players do not ever learn this positioning correctly. They do not repeat this positioning and motion in practice. They have no way of assessing their own performance of the correct positioning and motions.

A feature of an apparatus consistent with the foregoing objects is a brace having a base securable to an arm of a user or player. A yoke attached to one end of the base extends away from the base. The yoke may be fixedly attached or movably attached to the base. During use, the yoke and base remain in fixed relation to one another.

The yoke orients the forearm of the user with respect to an associated upperarm of the user. The yoke controls both relative closure, relative rotation, and extension of the forearm and the upperarm of the arm used for shooting. The yoke restrains the forearm from closing toward the upperarm beyond a predetermined angle. The yoke also urges the forearm into the proper rotational position with respect to the upperarm. The yoke also orients the shoulder complex to the proper angle.

The base may be configured to be secured to either the forearm or the upperarm (first member) of the arm of a user. As the forearm closes toward the upperarm, the yoke receives the second member (either upperarm or forearm) to which the base is not attached.

The yoke thus urges the second member to stop at a predetermined angle in the plane formed by a centerline through the forearm and a centerline through the upperarm. The yoke also urges a rotation of the plane, by urging rotation of the forearm to a predetermined position with respect to the upper arm.

The base and yoke may be fabricated separately and fastened together. An adjustable link may be interposed between the base and yoke for adjusting their relative positions including relative angles. Alternatively, they may be cast or molded monolithically.

A strap may be used to secure the base to the arm of the user. The strap may be configured with ends which may be selectively separated and attached with a fastener. A hook-and-loop fastener may be used to attach the ends at different positions, orientations and lengths to fit the arm of a user. Buckles, or "D-rings" with straps, neoprene tensioners, ratchet clips, terry bands/straps may also be incorporated.

Advantages of the apparatus include gauging for a user the correct positioning of the shooting hand, with its associated forearm, upperarm and shoulder. Another advantage is repeatability of the practiced positioning and motions of a user. Another advantage resulting from the foregoing is feedback to a user immediately with each shot. Another advantage is the provision of virtually perfect solo practice without a coach.

Another advantage is increased leverage of a basketball against the muscles in the arm and shoulder. A related advantage is creation of a proper length of the stroke of the hand of a user during a shot. Another related advantage is strengthening muscles due to the increased leverage. Another advantage is physiological or psychological "motor memory" occurring. Moreover, another advantage over strength training is that all muscles used in the body during a shot are exercised in proper relationship, being exposed to the proper forces and moving through the proper range of motion, increasing performance and theoretically avoiding muscular/boney damage from improper, repetitive movement.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
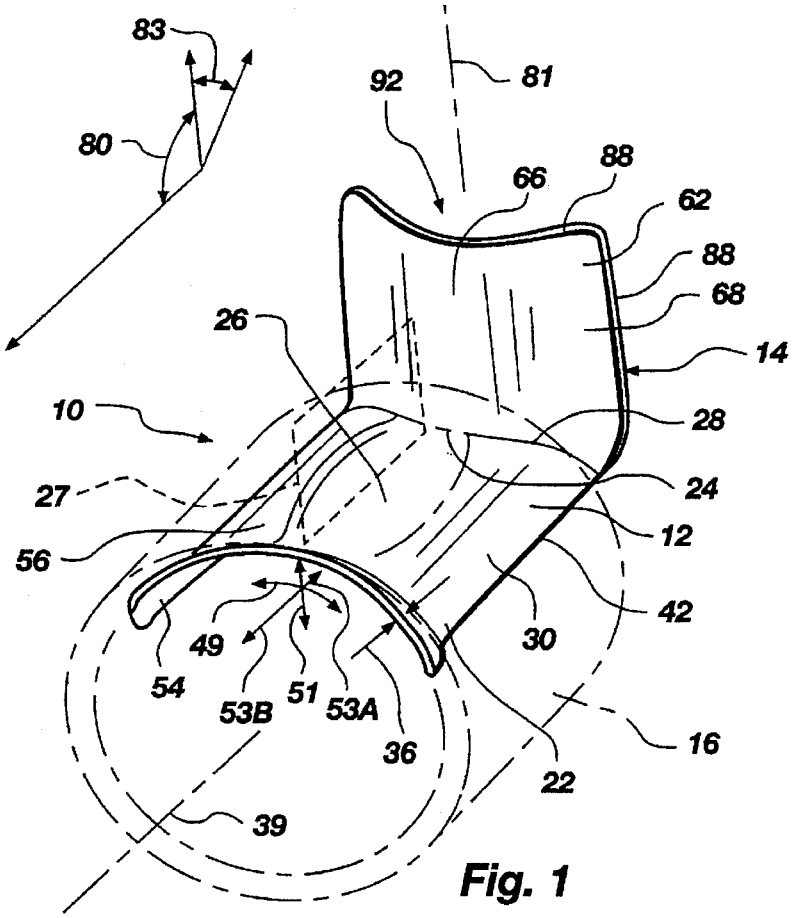
FIG. 1 is an isometric view of one presently preferred embodiment of an apparatus in accordance with the invention.
Figure 2:
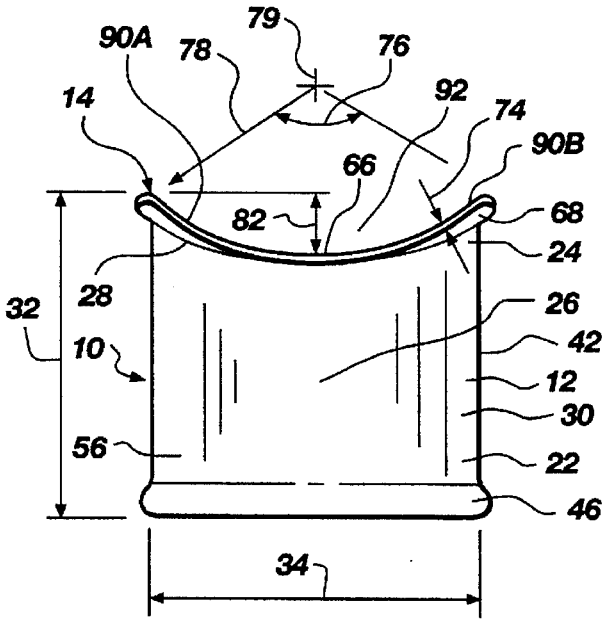
FIG. 2 is a top plan view of the apparatus of FIG. 1.
Figure 4:
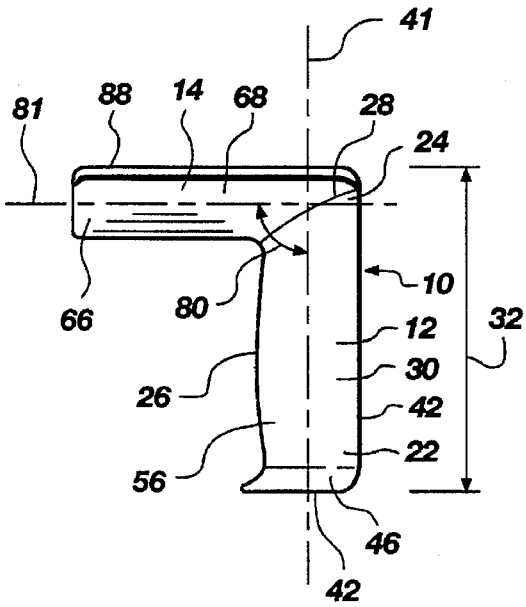
FIG. 4 is a right side elevation view of the apparatus of FIG. 1.
Figure 3:
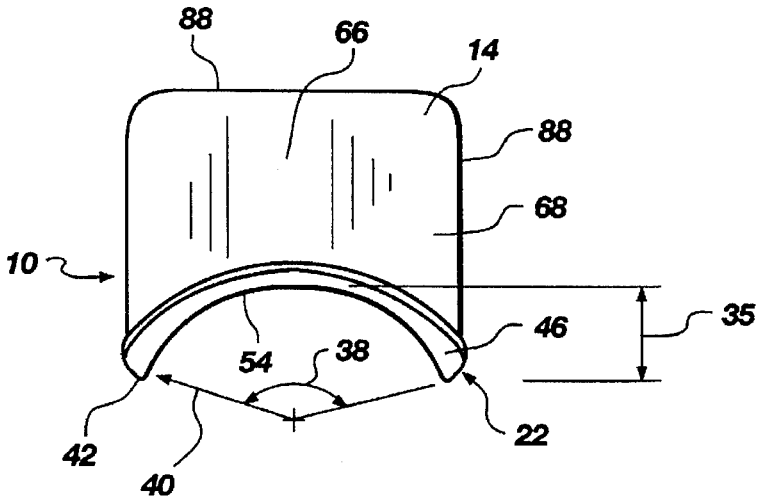
FIG. 3 is a front end elevation view of the apparatus of FIG. 1.
Figure 5:
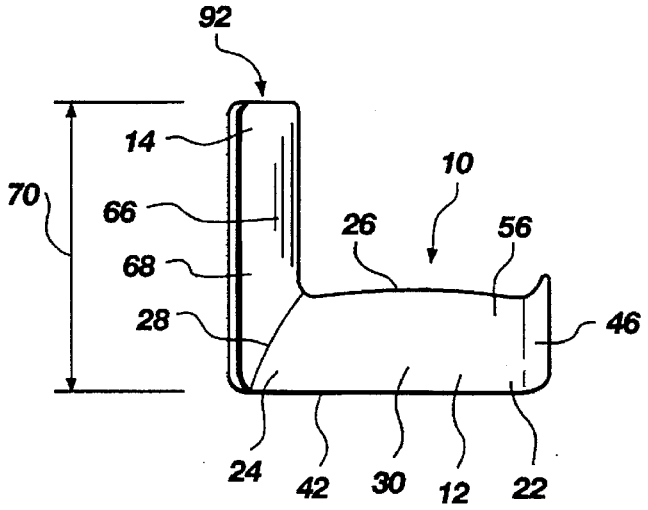
FIG. 5 is a left side elevation view of the apparatus of FIG. 1.
Figure 6:
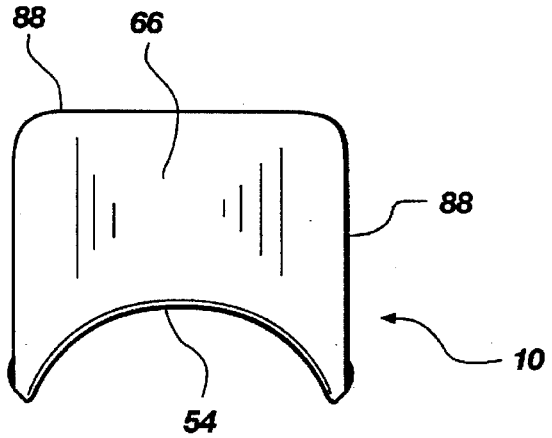
FIG. 6 is a back end elevation view of the apparatus of FIG. 1.
Figure 7:
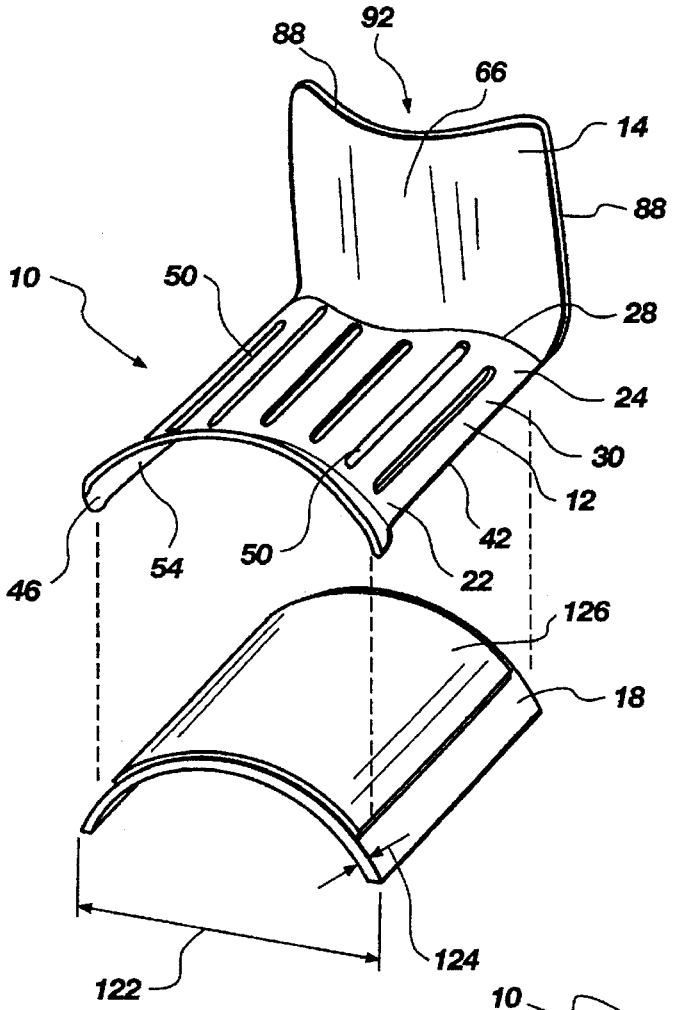
FIG. 7 is an isometric view of the apparatus of FIG. 1 including ventilation slots and a pad attachable to the base.
Figure 8:
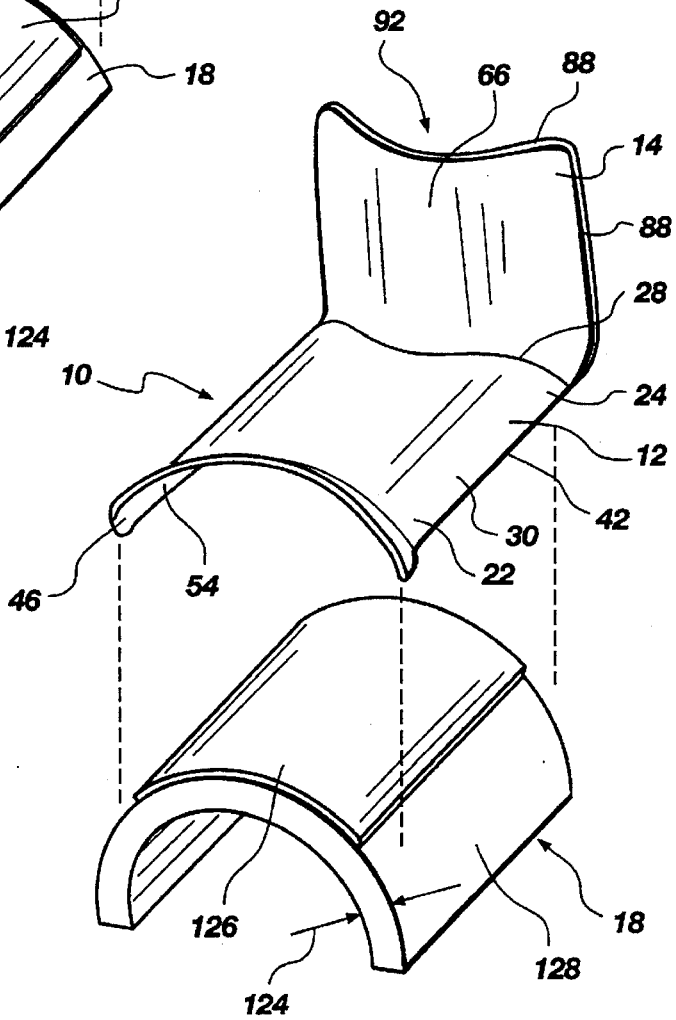
FIG. 8 is an isometric View of the apparatus of FIG. 1 provided with a shim and associated attachment layer for changing the size of the effective inside radius of the base.
Figure 9:
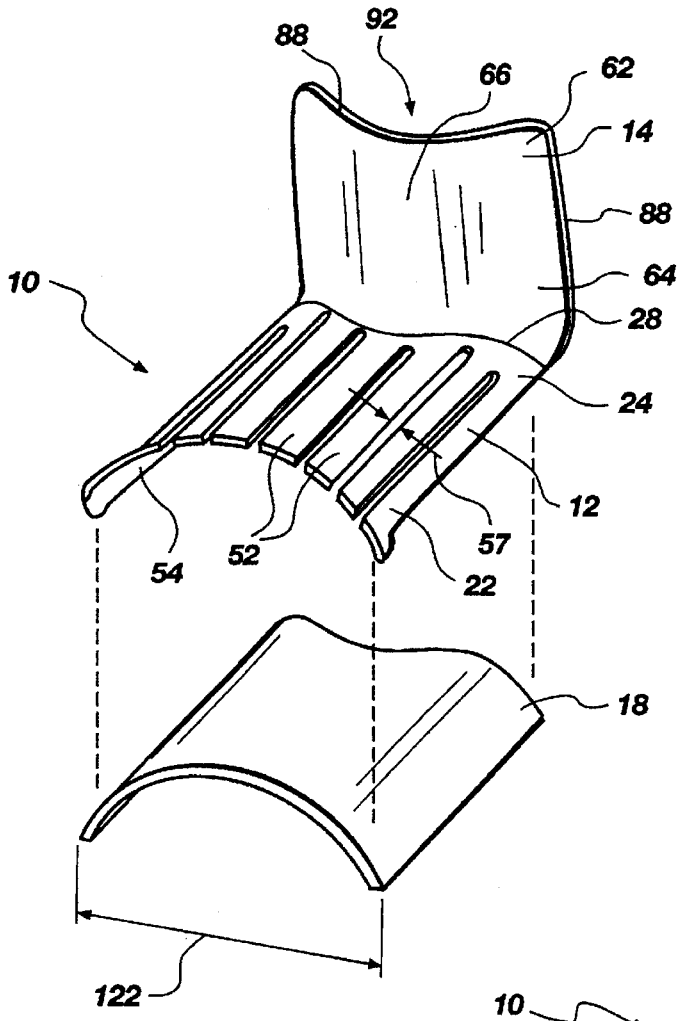
FIG. 9 is an isometric view of an apparatus having open fingers forming a base.

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 24, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

The apparatus is best understood by reference to FIGS. 1–23 and particularly to FIGS. 1–15. The apparatus 10, also referred to as a brace 10, is made to have a base 12 securable on an arm of a user. A yoke 14 extends away from the base 12 for orienting a forearm of the user with respect to an associated upperarm of the user. A band 16 or other attachment means suitable for wrapping around the arm of a user is attached over or otherwise to the base 12 for securing the base to the arm of the user. The apparatus may include a pad 18 fitting between the base 12 and the arm of the user, and a pad 20 for absorbing impacts of the member (forearm or upper arm) received into the yoke. The pad 20 is preferably a resilient pad having a thickness, stiffness, and energy absorption selected to absorb an impact of the member of the arm of the user.

The base 12 has a toe 22 and a heel 24. A bicep pocket 26 is formed therebetween along the inside surface 54 of the wall 30 of the base 12. Hypothetically, the bicep pocket 26 has a centerplane 27 passing vertically through it, for reference. The base 12 is curved to fit around a portion of a member (upperarm or forearm) of an arm of a user. The base 12 is connected to the yoke 14 (also curved to receive another member of the same arm of a user) by the joint 28, or dihedral joint 28. The length 32, width 34, and depth 35 of the base are selected to provide comfortable bearing area and to prevent sliding or rotation of the base 12 on the arm of the user. The pad 18 may be formed of a suitable material to achieve these effects. For example open-cell polymer foam, such as polyurethane is suitable, as is a combination of closed cell polymer foam lined with a fabric of cotton.

The depth 35 and thickness 36 are selected to achieve structural strength. The resulting contact angle 38 is defined by the width 34, depth 35 and the radius 40 from the centerline 39. A suitable contact angle is from 10 to 180 degrees with the range of 90 to 130 degrees preferred. A 120 degree contact angle 38 is suitable.

Figure 12:
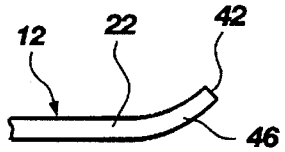
FIG. 12–14 are partial cutaway elevation views of a flared, beaded, and rolled edge, respectively.
Figure 13:
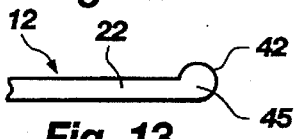
Figure 14:
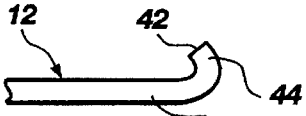
Figure 15:
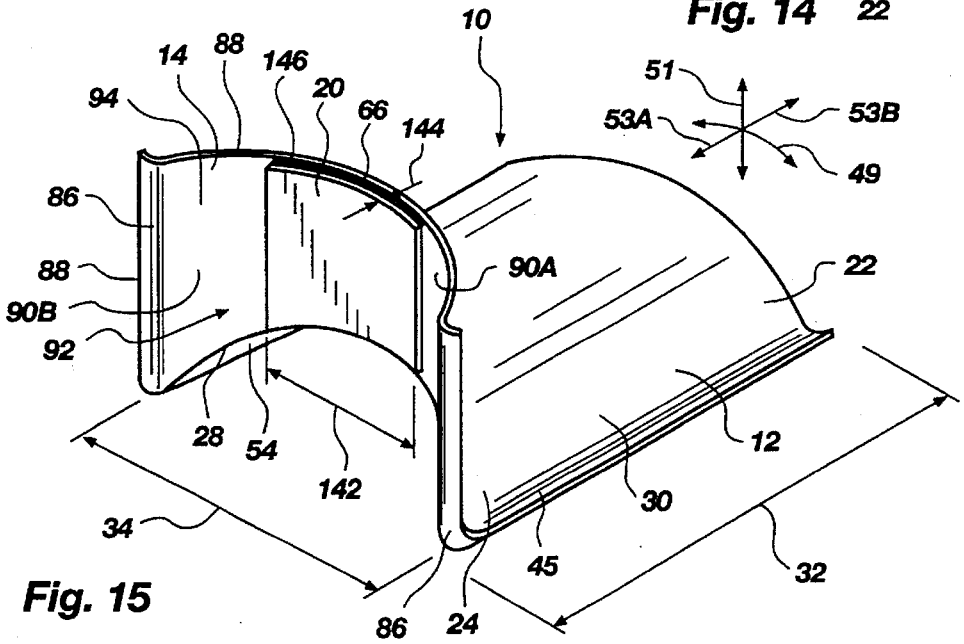
FIG. 15 is an isometric front quarter view of the apparatus of FIG. 11 augmented with a pad for absorbing impacts.

The edge 42 may be treated at any or all of its locations to prevent chafing or scraping against the skin of a user. Suitable treatments may include, for example, the addition of a roll 44, bead 45, flare 16 as shown in FIGS. 12–14. A combination of the roll 44, bead 45 and flare 16 may be used at various locations, and sometimes at the same location along the edge 42.

The vents 50 (See FIG. 7) may be formed to pass in a radial direction 51 through the base. The vents 50 may be extended to open (render discontinuous) the edge 42, forming fingers 52. The fingers 52 are preferably stiff, but flexible. The fingers allow an impact against the yoke 14, absorbing the impact by flexing. Because the fingers 52 can bend in the radial direction 51 as well as flex apart in the circumferential direction 49, the force exerted by the edge 42 of the toe 22 on the arm of a user is reduced in the embodiment of FIG. 9.

A band 18, such as a strap 102 may be wrapped or fastened about the outer surface 56 to extend in a circumferential direction 49. The band 18 secures the base to the arm of a user. The band 18 should also limit the separation distance 57 between the fingers 52. For example, the strap 102 of FIG. 11 may be connected or made to have a suitable restraint against excessive opening of the separation distance 57 during flexure of the fingers 52.

The base 12 need not have a bicep pocket 26. The base 12 can be configured to fit over the forearm of a user. In this embodiment, upon closure of the forearm toward the upper arm, the yoke 14 receives the upperarm. Thus, whether the base 12 is placed on the upperarm or forearm, the yoke 14 serves to orient the forearm with respect to the upperarm upon an attempt at closure, movement of the wrist toward the shoulder. The base member is the forearm or upperarm to which the base 12 is attached. The moving member is the remaining member (upperarm or forearm) that is received into the yoke 14.

The yoke 14 increases leverage on the moving member with the height 70 of the wall 68 forming the cradle 66 in the yoke 14. The height 70 is selected to optimize the leverage of the yoke 70 on the moving member while minimizing bulk. Safety and comfort also figure in the selection of the height 70. The yoke 14 and base 12 need not meet at a dihedral joint 28. However, the dihedral joint 28 makes possible a strong, light yoke 14.

The yoke may be made of a flexible material, such as high density polyurethane foam, that will collapse, bend or give. The yoke then will give in a forward longitudinal direction 53A upon impact, but resist a force in a backward longitudinal direction 53B. (See FIGS. 1 and 15.) The yoke may have a width 72, thickness 74, wrap angle 76, radius 78, and depth 82 selected to permit collapse toward the center of curvature 79.

Figure 10:
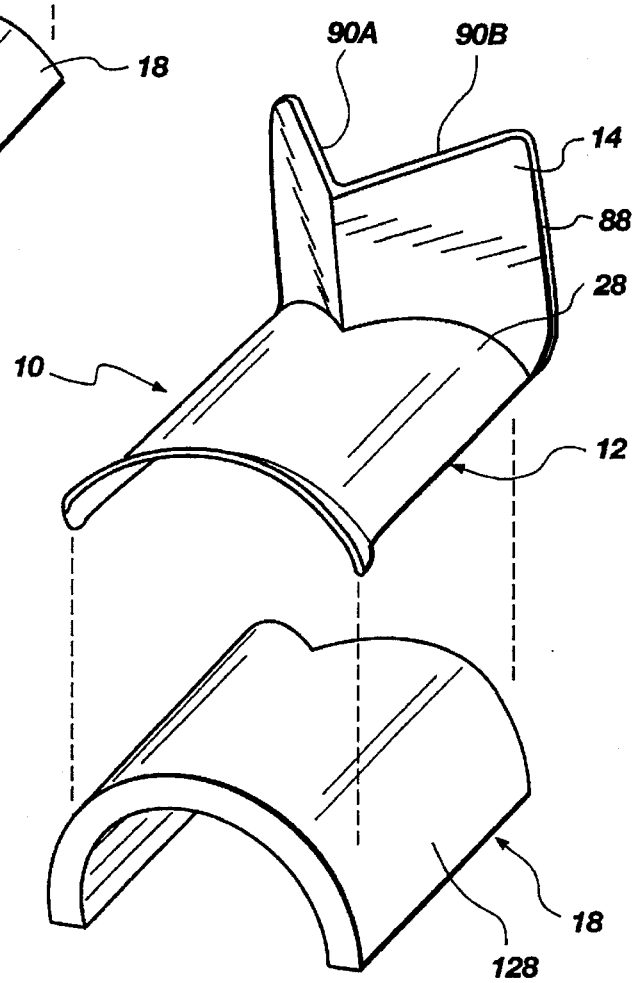
FIG. 10 is an isometric view of an apparatus having a rectangular yoke angle in lieu of a radiused yoke, the base being provided with a shim.

The wrap angle 76 may be from 5 to 180 degrees, depending on coverage of the arm of a user, and the radius 78. In the embodiment of FIG. 10, the radius may be considered that of any arm that would fit into the yoke 14 A wrap angle is preferably from about 70 degrees to about 130 degrees. The pad 20 need not cover the entire wrap angle but may cover approximately the center third of the wrap angle 76. Alternatively, the pad 20 may be positioned and sized to cover only a third of the inside surface 94 of the yoke 14. The extensive, remaining inside surface 94 beside the pad 20 is preferably smooth and slippery to form a guide and to prevent chafing as the arm (moving member) of the user is urged into alignment.

A center of curvature 79 need not be a single point, nor a single line in the radial direction 51. Any point on the yoke 14 may have its own center of curvature 79. The cradle 66 need not be formed as a right circular cylinder. The cradle 66 portion of the yoke 14, between the head 62 and the knee 64, may be formed to meet individual needs or skill levels. for example, the relative height 70, width 72, wrap angle 76 and radius 78 can be selected for a player's size, skill, and comfort.

The base 12 and yoke 14 meet to form a stop angle 80, and a sweep angle 83, defined by a yoke centerline 81 and a base centerline 39. The base centerline 39 corresponds (is aligned with, oriented similarly to) the base member, and the yoke centerline 81 similarly corresponds to the moveable member.

The sweep angle 83 may be thought of as approximately the angle of rotation of the forearm about the upperarm, with respect to the bicep pocket 26 in the base 12. The sweep angle 83 may be from about negative 15 to about positive 45 degrees, depending on a user's physical development.

The sweep angle 83 may also be thought of as the angle made by a yoke centerline 81 with respect to the base 12, and specifically the centerplane 27 of the bicep pocket 26. One embodiment of the apparatus may be made with a sweep angle of zero degrees. The position of the base 12 in the circumferential direction 49 is adjustable around the arm, thus, the sweep angle 83 of zero degrees.

The base 10 is simply rotated to the proper position (typically slightly outboard of the bicep) before being attached on the upper arm. The user may set the base 12 on one upper arm and rotate the associated forearm until the wrist, elbow and shoulder intersect approximately the same vertical plane. Then, the user closes the forearm toward the shoulder until the forearm rests against the inside surface 94 of the cradle 66 of the yoke 14. Then the user secures the base 12 against the upper arm with the strap 102.

As with the base 12, a flare 84, bead 85 (not shown) similar to the bead 45, or roll 86 can be formed at the edge 88 of the yoke 14. (See FIGS. 11–15.) These treatments of the edge 88 promote safety and comfort of the user, while improving strength and stiffness of the yoke 14.

In one presently preferred embodiment, the sides 90A, 90B may be advantageously formed in one preferred embodiment of a material selected to be smooth and slippery. This arrangement reduces chafing or other discomfort, although the sides are not ideally contacted by a user. That is, a user ideally aligns the forearm to be received into the pocket 92. The forearm then comes to rest against the inside surface 94 of the cradle 66 or a pad 20 secured thereto. If a user does not rotate the forearm of the shooting hand into a proper position, the forearm will be urged toward the centerline 81 by the sides 90A, 90B. A pad 20 is used to absorb the impact of closure of the arm of a user against the yoke 14.

Figure 11:
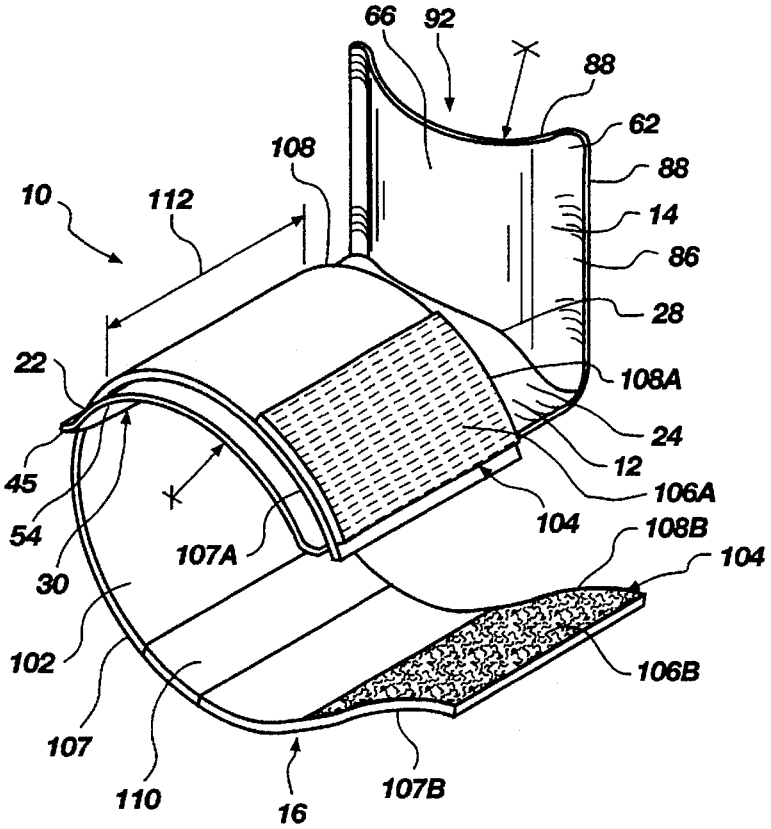
FIG. 11 is an isometric rear quarter view of an apparatus having an open, adjustable strap.

The bands 16 as seen in FIGS. 1, 11, 16–21, and 23 may be configured as a strap 102 or straps 102. The band 16 may be closed on itself. The band 16 may form a continuous loop. Such a band 16 would preferably be elastically extendible for positioning around an arm of a user. The strap 102 is preferably a single piece of material such as a durable, strong, inextensible fabric. Nylon webbing is a suitable material and is available in a variety weaves. The strap 102 is preferably open ended as illustrated in FIG. 11. The fasteners 104 attached to the strap 102 are preferably a hook pad 106A and a loop pad 106B forming a hook-and-loop type of fastener 104.

Alternate fasteners 104 are less preferred, but may be made serviceable and adjustable. Examples of such fasteners 104 contemplated include buckles on straps, hook and eye fasteners, laces through eyelets, snaps, zippers, double "D"-rings on straps, multiple straps having hook-and-loop pads (panels) for attaching at one end, ratcheting straps, clips, levers, and buttons.

Connection of the hook pad (panel) 106A to the loop pad (panel) 106B need not form the strap 102 into a cylinder. The two edges 107, 108 need not remain parallel. That is the ends 107A, 108A of edges 107, and 108, respectively, need not align with the two ends 107B, 108B. Since the upper arm (and forearm, in some embodiments of the apparatus) is not of a constant diameter, either edge 107 or 108 will probably traverse a longer path around the arm of a user. Thus, the fastener 104 is preferably one that will enable this important adjustability to accommodate the shape of the arm of a user.

Moreover, a larger width 112 creates a larger load bearing area against the arm of a user. An optional elastic section 110 may be inserted for relieving stress due to impacts of other players against a user. The result of either of these options is lower stress (continuous and impact derived, respectively) on the skin, muscle, tendons, bones and other components of the arm of a user. Thus the width 112 of a preferred strap 102 covers a substantial fraction of the length 32 of the base 12. A short elastic section 110 may be comprised of an elastic material that is relatively stiff. Relatively stiff means here that the size and stiffness is such that only an impact or other load larger than would normally be comfortable for a user will elongate the elastic section 110.

A pad 18 is optional. The pad 18 may be selected for comfort and for holding securely against the skin of an active user. A suitable embodiment may include a pad 18 having a width 122 that almost covers the inside surface 54 of the base 12. However the thickness 124 may be very thin, from a few thousandths of an inch to about an eighth of an inch is preferred. A binding layer 126 may be a separate layer of permanent or removable adhesive, a double-sided adhesive tape, or a solvent film. However, a pad may be removably attached also.

Removable adhesive can be useful for attaching a shim 128. A shim 128 may be a pad 18 sized to decrease the inside radius 40 of the base. Thus, a shim 128 may be used to size a standard brace 10 or apparatus 10 for a smaller user. A brace 10 may also be used for different players from time to time by adding a shim 128.

The pad 20 may be sized to have a width 142 that does not cover the inside surface 94 of the yoke 14. The width 122 is preferably about a half to about a third of the width 72 of the yoke 14. That is, the pad 20 operates by virtue of its selected thickness 144, energy absorption and resilience to cushion impacts from the arm of a user coming to rest in the yoke 14. By contrast, the sides 90A, 90B may benefit the user by being smooth, slippery and exposed to prevent wear or chafing against the skin. A binding layer 146 operates similarly to the binding layer 126 discussed. Also, a pad 20 could be a shim 148 (not shown) sized as the shim 128 to accommodate the size or orientation (stop angle 80 or sweep angle 83) of the member received in the yoke.

Suitable materials for the apparatus 10 include metals, polymeric, and elastomeric materials. Combinations of materials are contemplated also. For example styrene compounds, acrylonitrile butadiene styrene (ABS), polyvinyl chloride (PVC), vinyl, nylon, polyurethane, olefinics such as polyethylene and polypropylene, polycarbonate, natural and synthetic elastomers such as rubber, and metals including aluminum, iron, and steel. Various combinations of these materials can also be used. Also, reinforced resins may form a matrix around fibers of KEVLAR™, polyethylene, graphite, glass, steel or aluminum for improving tensile strength. Likewise, a polymer selected may be expanded, "foamed," to reduce weight, improve safety, increase cross section for stiffness or strength, to soften the material, promote rounded edges, or to reduce cost.

Figure 16:
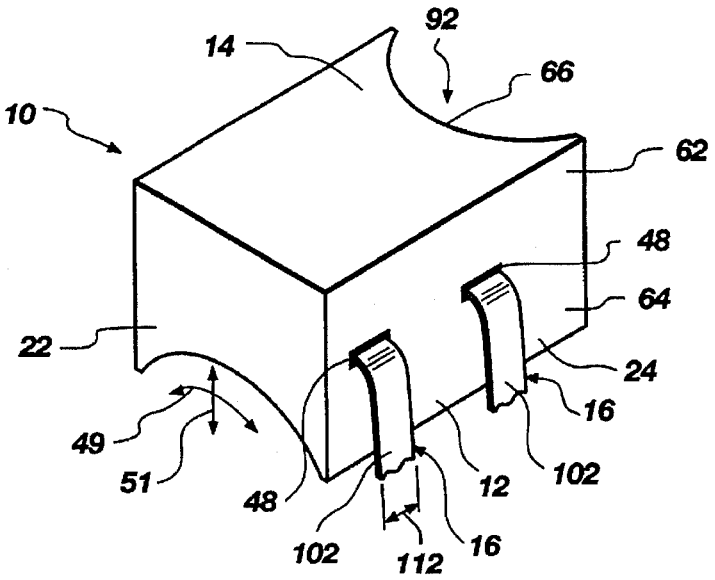
FIG. 16 is a rear quarter isometric view of an alternate embodiment of an apparatus according to the invention and molded in a block format, a format adaptable to use with expanded (foamed) polymer resins.
Figure 17:
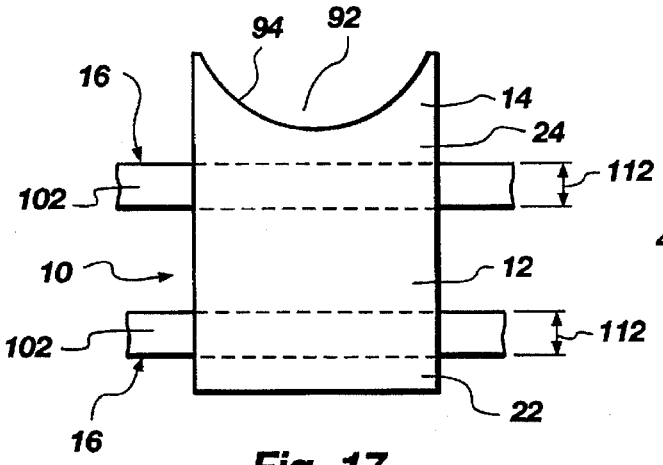
FIG. 17 is a top plan view of the apparatus of FIG. 16.
Figure 18:
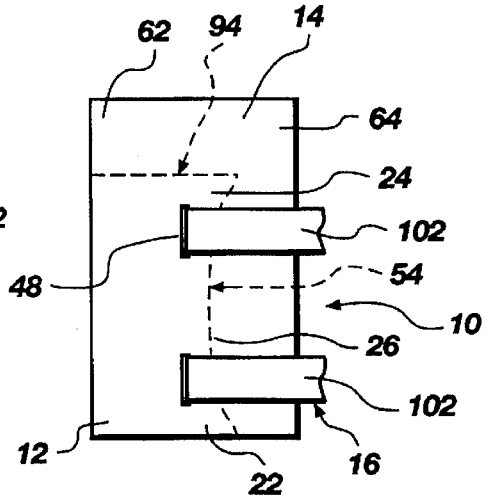
FIG. 18 is a right side elevation view of the apparatus of FIG. 16.
Figure 19:
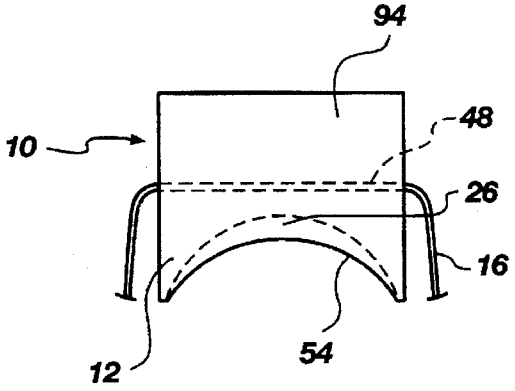
FIG. 19 is a front end elevation view of the apparatus of FIG. 16.
Figure 20:
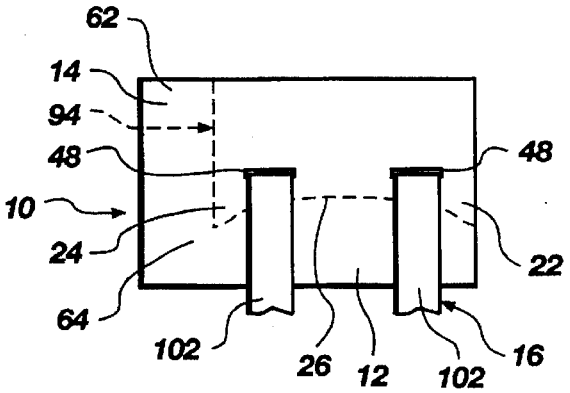
FIG. 20 is a left side elevation view of the apparatus of FIG. 16.
Figure 21:
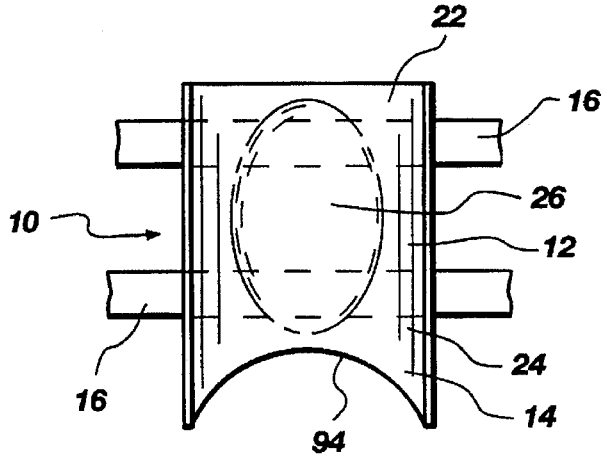
FIG. 21 is a bottom plan view of the apparatus of FIG. 16.
Figure 22:
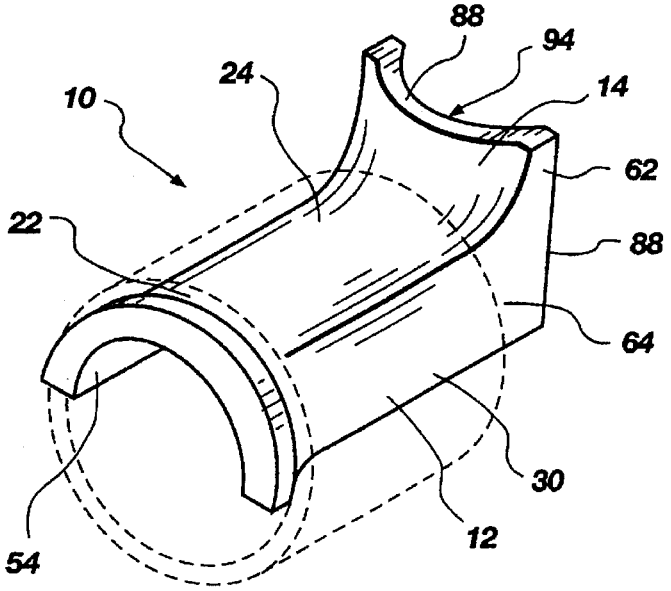
FIG. 22 is a rear quarter isometric view of an alternate embodiment of an apparatus according to the invention and molded in a shaped format, a format adaptable to use with expanded (foamed) polymer resins.
Figure 23:
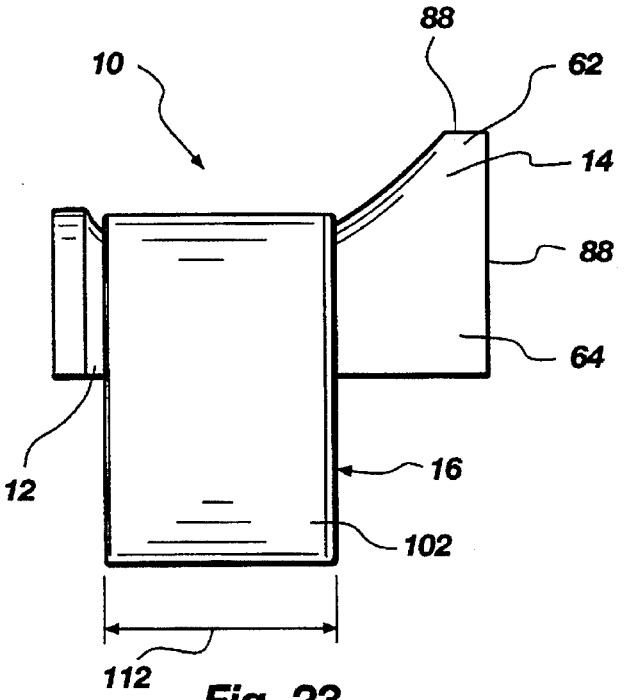
FIG. 23 is a side elevation view of the apparatus of FIG. 22 with one embodiment of a strap surrounding the base.

The embodiments of FIGS. 16–23 operate similarly to the embodiments of FIGS. 1–15. However The embodiments of FIGS. 16–23 are more readily adaptable to molding with comparatively soft, foamed polymers. Suitable materials would include styrofoam, low density polyurethane, low density polyethylene and similarly performing materials. The large, block-like shape of the brace 10 FIG. 16 is readily adaptable to use by children in primary schools.

Multiple straps 102 through the base 12 or a single wide strap over the base 12 may be suitable. The slots 48 may be formed in the base, traversing in a circumferential direction 49 around the arm to which a strap 102 is secured. The embodiment of FIG. 23 may rely on a strap 102 that is a closed, elastic loop similar to a sweat band. A primary school child could easily slip the brace on and off. The large size of the brace would render the brace effective, yet very safe. A low density polyurethane such as is commonly used for sleeping pads could exert enough force to be useful. However, such a material could not exert enough force upon impact to cause injury.

Figure 24:
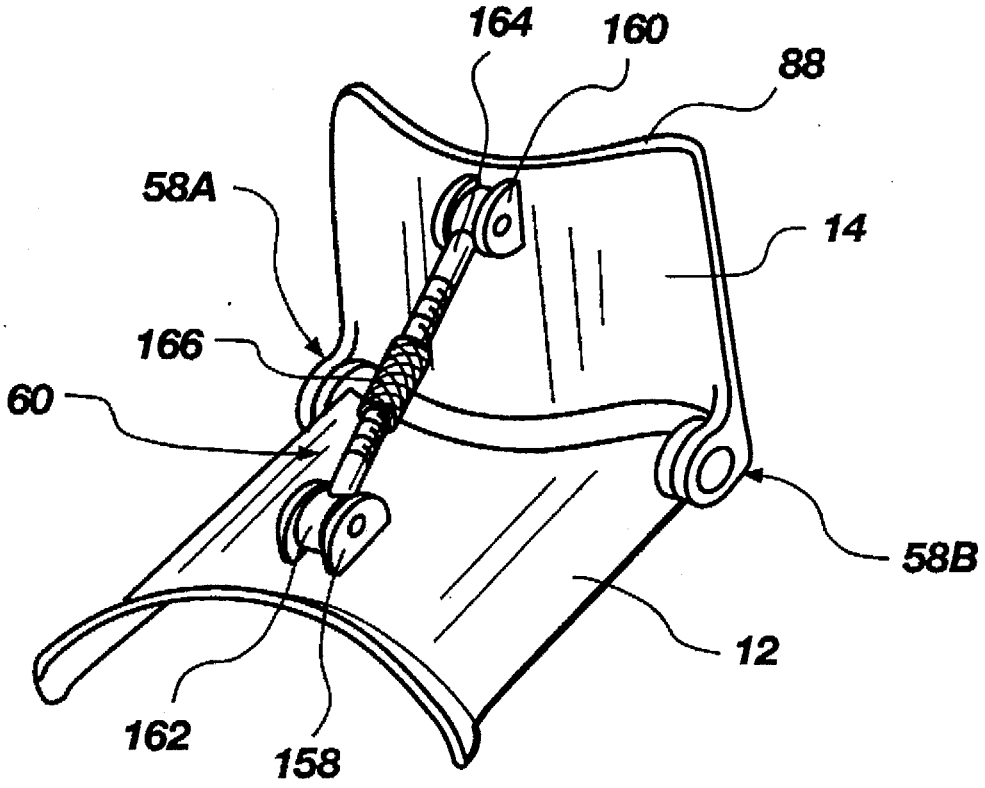
FIG. 24 is a rear quarter isometric view of an alternate embodiment of an apparatus according to the invention to have a yoke adjustably movable with respect to the base.

FIG. 24 illustrates yet another preferred embodiment of an apparatus having a base 12 pivotably connected to a yoke 14. The yoke 14 may be pivotably attached to the base 12 at the joints 58A, 58B. In one presently preferred embodiment, an adjustable member 60 connects between the base 12 and yoke 14. Brackets 158, 160 may be of the clevis type for holding a threaded eye rod 162 and reverse-threaded eye rod 164 of the adjustable member 60, respectively, connected by a turnbuckle 166. The turnbuckle 166 may be knurled as shown, and can be configured to adjust the orientation of the yoke 14 with respect to the base 12. The stop angle 80 may be set at a desired value. The base 12 and yoke 14 may also be made adjustable in a similar manner to control the sweep angle 83.

Other adjustment mechanisms may include, for example, fixed blocks fastened to restrain the yoke 14 at a desired position; multiple adjustment members, and bendable metal skeletons inside plastic outer covers forming the apparatus 10. In one embodiment, the yoke 14 may be adjusted by warming and softening the plastic material of which the apparatus 10 is formed. The yoke 14 may alternatively be made rigidly attachable at a selected one of a plurality of locations along the base 12.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A positioning apparatus for controlling the position of the shooting arm of a user shooting a basketball, the apparatus comprising:

a base securable on an upperarm of a user;

a yoke curved to nest a forearm of a user, the yoke extending away from the base at a first angle in a first plane, and a second angle in a second plane, the first and second angles being selected to orient the forearm of the user at a position effective for shooting a basketball, with respect to the upperarm of the user;

means connected to the base for securing the base to the upperarm sufficiently firmly to resist the force applied by the forearm closing toward the upperarm;

a pad positioned in the yoke to extend across a center portion thereof for absorbing an impact of the arm against the yoke; and a guide surface on the yoke, substantially smooth and extending from the edges of the pad to the edges of the yoke a distance effective to allow contact therewith by an arm of a user for reducing friction of the arm thereagainst.

2. The apparatus of claim 1 further comprising a dihedral joint connecting a curved wall of the base to a curved wall of the yoke.

3. The apparatus of claim 1 wherein the guide surface is effective to control rotation of the forearm with respect to the upperarm.

4. The apparatus of claim 1 further including means for adjusting the securing means.

5. The base of claim 1 further comprising flexible fingers positionable to extend along the arm of the user.

6. The base of claim 1 comprising a perforated wall for ventilating the arm of the user.

7. The apparatus of claim 1 wherein the yoke comprises a flexible material.

8. The apparatus of claim 1 wherein the means for securing the base to the arm of the user comprises a strap openable for attachment to and removal from the arm of the user.

9. The apparatus of claim 1 wherein the securing means comprises a strap comprised of a material selected to be flexible in bending and substantially inextensible in length.

10. The apparatus of claim 7 further including an extensible member attached to the strap for relieving impact stresses in the strap.

11. The apparatus of claim 1 wherein the securing means comprises a strap having a first end and a second end.

12. The strap of claim 11 further comprising the first end having attached thereto a hook panel and the second end having attached thereto a loop panel, the hook panel and the loop panel being connectable to form a hook and loop fastener for shaping the strap to be snugly fittable around the arm of the user.

13. The apparatus of claim 1 further comprising a shim attached to the base.

14. The apparatus of claim 1 wherein the yoke is moveable with respect to the base, and further comprising an adjustment member connectable between the yoke and the base to position the yoke with respect to the base.

15. The apparatus of claim 1 wherein the yoke has a radius and is comprised of a material selected to be deflectable when loaded in a direction toward a center of the radius of the yoke for deflecting upon impact.

16. The apparatus of claim 1 wherein the apparatus is comprised of a curved wall having a radius extending from a center of curvature to an inside surface of the wall, the wall being comprised of a material selected to substantially resist loads applied thereto in a direction from the center of curvature toward the wall, and to substantially deflect in response to loads applied thereto and directed toward the center of curvature.

17. A brace for positioning a forearm of a user, shooting a basketball, with respect to an associated upperarm, at a first angle in a first dimension, and a second angle in a second dimension, the first and second angles being selected to enforce a proper basketball shooting position of the upperarm in an elevation direction with respect to the torso of the user by positioning the forearm in the first and second dimensions with respect to the upperarm, the brace comprising:

a first yoke adapted to fit the upperarm of the user;

a second yoke, curved for receiving, at the first angle in the first dimension and the second angle in the second dimension, a forearm associated with the upperarm;

a strap connected to the first yoke and effective to firmly secure the brace to the to resist the force exerted by the forearm with respect to the upperarm;

a pad positioned in the yoke to extend across a center portion thereof for absorbing an impact of the arm against the yoke; and a guide surface on the second yoke, substantially smooth and extending from the edges of the pad to the edges of the yoke a distance effective to allow contact therewith by an arm of a user for reducing friction of the arm thereagainst.

18. The brace of claim 17 further comprising a dihedral joint connecting a curved wall of the first yoke to a curved wall of the second yoke.

19. The apparatus of claim 18 further including a guide surface on the second yoke for controlling rotation of the forearm with respect to the upperarm.

20. The apparatus of claim 19 wherein the guide surface is smooth for reducing friction of the forearm thereagainst.

21. The apparatus of claim 18 wherein the strap has a length selectively adjustable by the user.

22. The apparatus of claim 21 wherein the strap includes a first end and a second end, the first end and second end being selectively separable and closeable for attachment to and removal from the arm of the user.

23. The apparatus of claim 22 further including a resilient pad positioned against an inside surface of the second yoke to absorb an impact of the forearm against the inside surface.

24. The apparatus of claim 23 wherein the curved wall of the first yoke is further comprised of a material perforated to ventilate the upperarm of the user.

25. The apparatus of claim 24 wherein the strap is comprised of a material selected to be flexible in bending and substantially inextensible in length.

26. The strap of claim 25 further comprising the first end having attached thereto a hook panel and the second end having attached thereto a loop panel, the hook panel and the loop panel being connectable to form a hook and loop fastener for shaping the strap to be snugly fittable around the arm of the user.

27. The apparatus of claim 26 further including an extensible member attached to the strap for relieving impact stresses in the strap.

28. The apparatus of claim 17 wherein the yoke is comprised of a material selected to be flexible upon impact with another user.

29. The apparatus of claim 17 wherein the second yoke has a radius of curvature and is comprised of a material selected and shaped to be deflectable with a force acting in a direction toward a center of curvature.

30. The apparatus of claim 29 wherein the material is selected and the yoke is sized to substantially resist a force applied in a direction from the center of curvature toward a wall of the second yoke.

31. The apparatus of claim 17 further comprising a shim attached to an inside surface of the first yoke.

32. The apparatus of claim 31 wherein the shim has a thickness selected to change a radius of curvature of the first yoke.

33. The apparatus of claim 17 wherein the second yoke is moveable with respect to the first yoke, and further comprising an adjustment member connectable between the first yoke and the second yoke to position the second yoke with respect to the first yoke.

34. A method of training a user to shoot a basketball, the method comprising:

positioning on an arm of a user a brace comprising:

a base secured to the an upperarm of the user, a curved yoke extending away from the base at a first angle in a first dimension, and a second angle in a second dimension, the first and second angles being selected to orient the corresponding forearm with respect to the upperarm at a position effective for shooting a basketball, and means for securing the base to the arm of the user;

placing a basketball in the hand associated with the forearm;

aligning in rotation, in the second dimension, about the corresponding elbow, the forearm with respect to the upperarm;

drawing together the forearm and the upperarm at the first angle in the first dimension;

moving the forearm against a substantially smooth guide surface near and outer portion of the yoke;

urging the forearm to a proper sweep angle and toward a center portion of the yoke;

nesting the forearm against a resilient pad positioned in a central portion of the yoke at the first and second angles with respect to the upperarm;

holding the forearm against the brace;

lifting the upperarm to a position effective to enable the forearm to be extended therefrom to shoot the basketball; and extending the forearm to throw the ball toward a goal.

* * * * *

UNITED STATES PATENT AND TRADEMARK OFFICE

CERTIFICATE OF CORRECTION

PATENT NO. : 5,651,743

DATED : July 29, 1997

INVENTOR(S) : Paul B. Stephan et al.

It is certified that error appears in the above-identified patent and that said Letters Patent is hereby corrected as shown below:

In column 1, line 62, please delete "That, is", and insert therefor -- That is, --.
In column 4, line 32, please delete "View", and insert therefor -- view --.
In column 6, line 41, after the words "the yoke 14", please insert -- . --

In column 6, line 56, please delete "for", and insert therefor -- For --.
In column 7, line 46, after the word "variety", please insert the word -- of --.
In column 8, line 59, please delete "However The", and insert therefor -- However, the --.
In column 10, line 18, please delete "7", and insert therefor -- 9 --.
In column 10, line 61, after the words "secure the brace to the" please insert the word -- upperarm --.
In column 12, line 32, please delete "and", and insert therefor -- an --.

Signed and Sealed this

Eighteenth Day of November 1997

*Attest:*

Bruce Lehman

BRUCE LEHMAN

*Attesting Officer*

*Commissioner of Patents and Trademarks*